US005649492A

United States Patent [19]

Chin-Shu

[11] Patent Number: 5,649,492

[45] Date of Patent: Jul. 22, 1997

[54] STRUCTURE OF STORE PALLET FOR PACKING OR TRANSPORTING

[76] Inventor: Lin Chin-Shu, Sec. 5, Nan-Chu Road, Lu-Chu Hsiang, Tao-Yuan Hsien, Taiwan

[21] Appl. No.: 620,550

[22] Filed: Mar. 25, 1996

[51] Int. Cl.[6] ..... B65D 19/00

[52] U.S. Cl. ..... 108/51.3; 108/56.3

[58] Field of Search ..... 108/51.3, 56.3, 108/56.1, 51.1

[56] References Cited

U.S. PATENT DOCUMENTS

| | | | |
|---|---|---|---|
| 2,631,724 | 3/1953 | Wright | 108/51.3 X |
| 3,123,020 | 3/1964 | Voissen | 108/56.3 X |
| 3,407,758 | 10/1968 | Simkins | 108/56.3 X |
| 4,604,014 | 8/1986 | Frano | 108/56.3 X |
| 4,850,284 | 7/1989 | DeGroot et al. | 108/51.3 X |
| 5,289,781 | 3/1994 | Beckway | 108/51.3 |
| 5,513,577 | 5/1996 | Weis | 108/56.3 |

FOREIGN PATENT DOCUMENTS

| | | | |
|---|---|---|---|
| 2676711 | 11/1992 | France | 108/51.3 |

*Primary Examiner*—Jose V. Chen
*Attorney, Agent, or Firm*—Pro-Techtor International

[57] ABSTRACT

A novel assemblable structure of paper pallets for packing or transporting, before being assembled, they occupy very small space and are favourable for transporting and storing. An amount of openings are provided on the bottom plate of each paper pallet, an amount of first assembling members, pipes and second assembling members can be assembled in and beneath the openings to form a plurality of columns, a stacker can be used to transport by taking advantage of the space among the columns. The paper pallets only are assembled when in use, so that normally, a large space can be saved for storing, and efficiency of transporting can be largely increased, procedure of assembling is much easier and simpler than a conventional pallet assembled by binding or gluing.

2 Claims, 8 Drawing Sheets

STRUCTURE OF STORE PALLET FOR PACKING OR TRANSPORTING

BACKGROUND OF THE INVENTION

1. Field of the Invention

The present invention is directed to a novel structure of a paper pallet for packing or transporting, the bottom thereof is an assemblable style structure, a plurality of assembling members can be connected easily when it is necessary to assemble them for making a bottom rack of the pallet.

2. Description of the Prior Art

In the industry of manufacturing, many products are too heavy to be transported, therefore, store pallets were developed for holding them to allow a stacker to transport them. Store pallets used to be made from wood boards which were nailed together. They are firm and durable, they have been gradually being substituted by other material though because of gradual elevating of sense of environmental protection and gradual reducing of the resources of wood. In these substituting materials, paper pallets can be recovered for recycling, besides, the manufacturers in the art developed a hard paper board of high density and being able of standing high pressure, in view of this, the hard paper board is highly welcome; the conventional paper pallets, such as shown in FIG. 1, are comprised each of a packing bottom plate 10, two boards 11, 13 which are connected by glue, and a plurality of blocks 12. The paper pallets are made by gluing the boards 11, 13 and the blocks 12 onto the packing bottom plates 10, and are handed over to manufacturers for use when products are sent out. However, they have the following disadvantage:

1. The packing bottom plates 10 is preformed by gluling, a frame thereon has been formed by bending and binding, therefore, when a lot of paper pallets are transported, efficiency of transportation is not good due to the height and large space they occupy.

2. When they are stored in the manufacturer's place and are ready for use, they are piled very high and occupy quite large space, this is a problem to a manufacturer having limited room of factory.

3. The gluing method needs time for drying, this adversely influences flow of process, and undried glue often leds to disconnection and inability of use.

SUMMARY OF THE INVENTION

The inventor of the present invention provides a practical as well as novel structure of paper pallets, in view of the above stated disadvantage and based on understanding and experience of study as well as developing on the pallets for several decade of years, for solving inconvenience resided in the conventional paper pallets.

The principal object of the present invention is to provide a structure of paper pallets which can be assembled easily, before the pallets are used, paper boards thereof are spreaded out and piled one on the other for convenience of transportation and storing, and are ready for being assembled in a easy way when in use.

The secondary object of the present invention is to get rid of the defect of trouble in gluing as well as of easiness of coming off resided in the conventional paper pallets by the structure of assembled store pallets.

The present invention will be apparent in its practical structure and functions after reading the detailed description of the preferred embodiments thereof in reference to the accompanying drawings.

DETAILED DESCRIPTION OF THE PREFERRED EMBODIMENT

Figure 1:
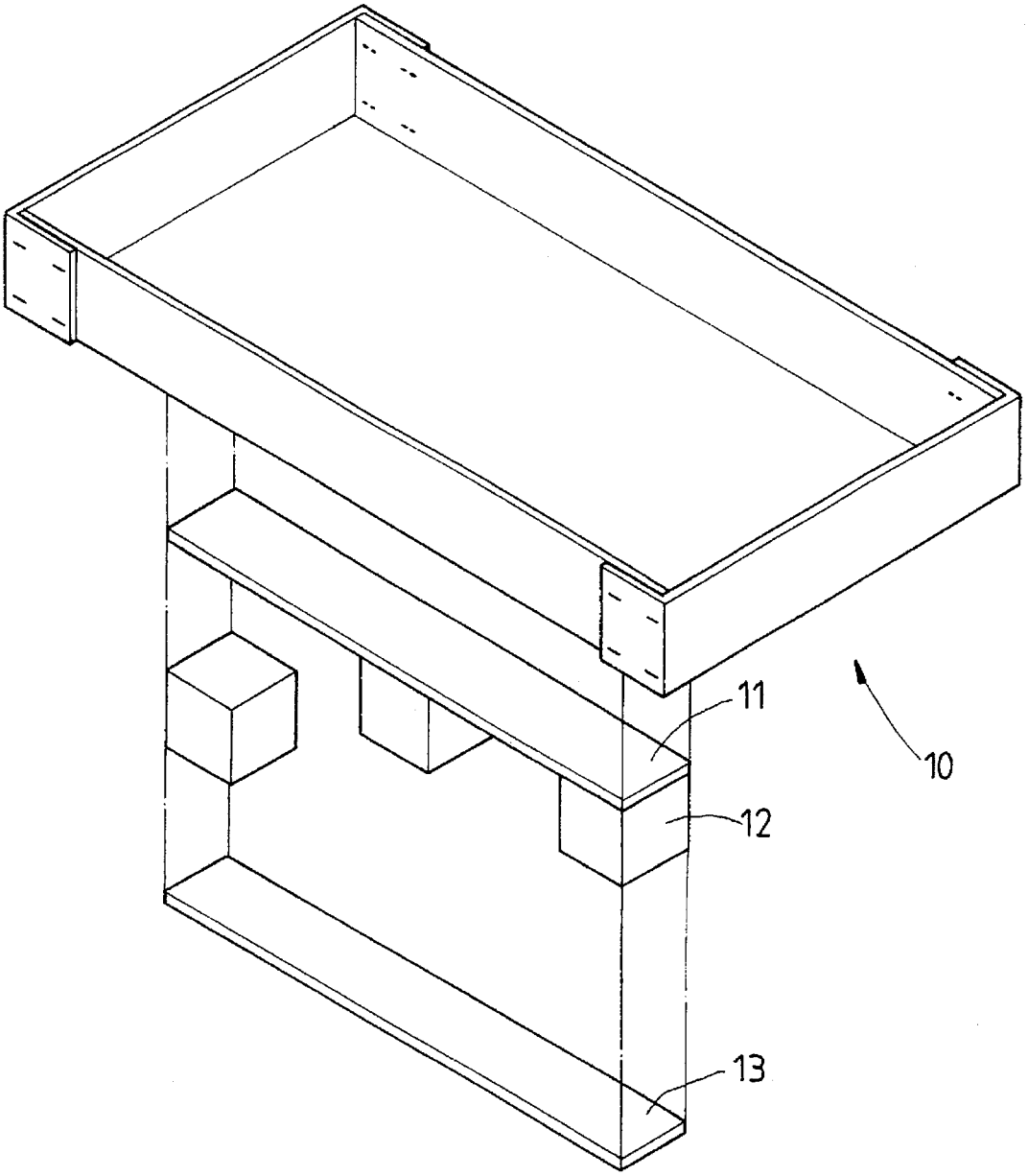
FIG. 1 is an analytical perspective view of a conventional pallet.
Figure 2:
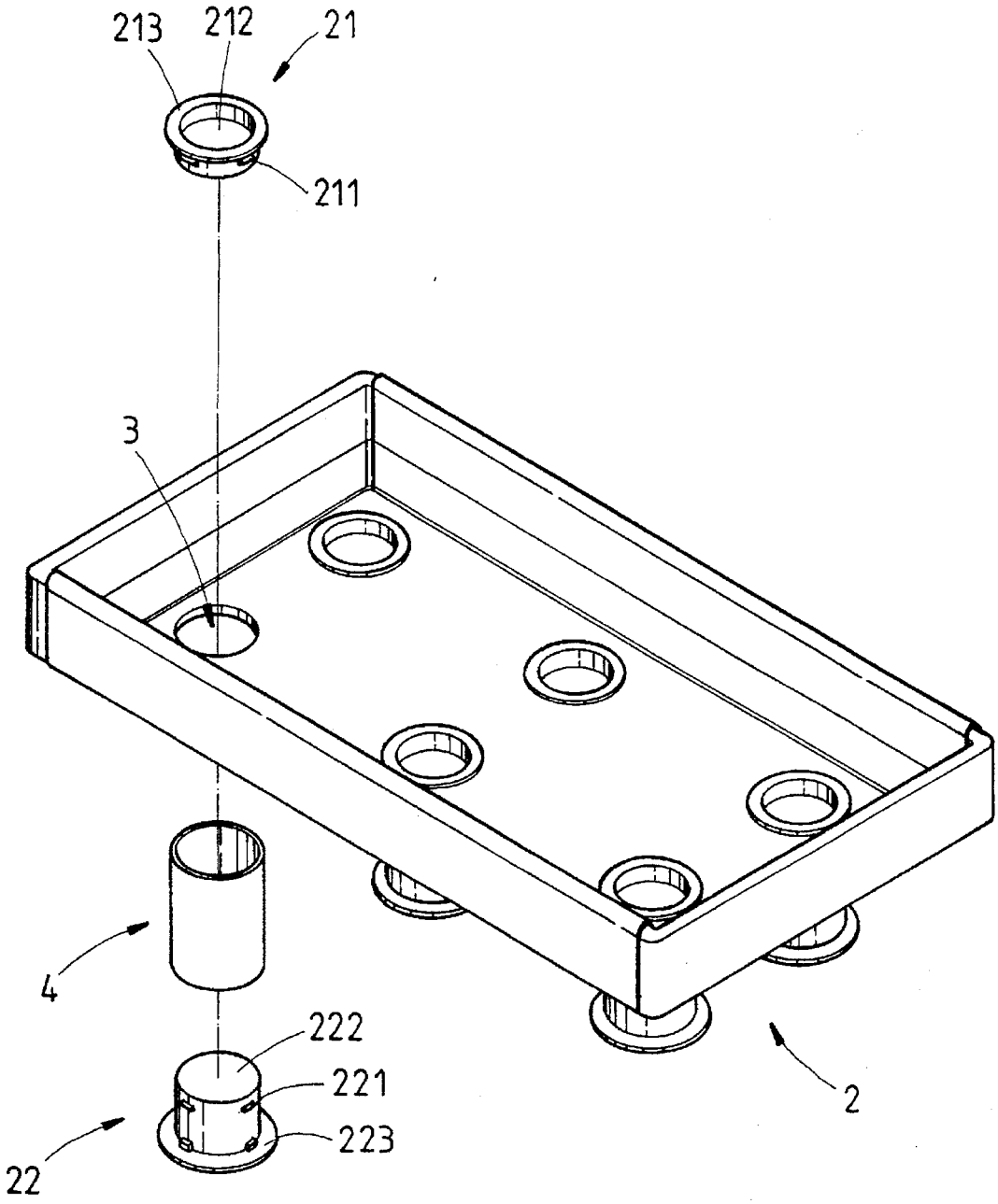
FIG. 2 is an analytical perspective view of the present invention.
Figure 3:
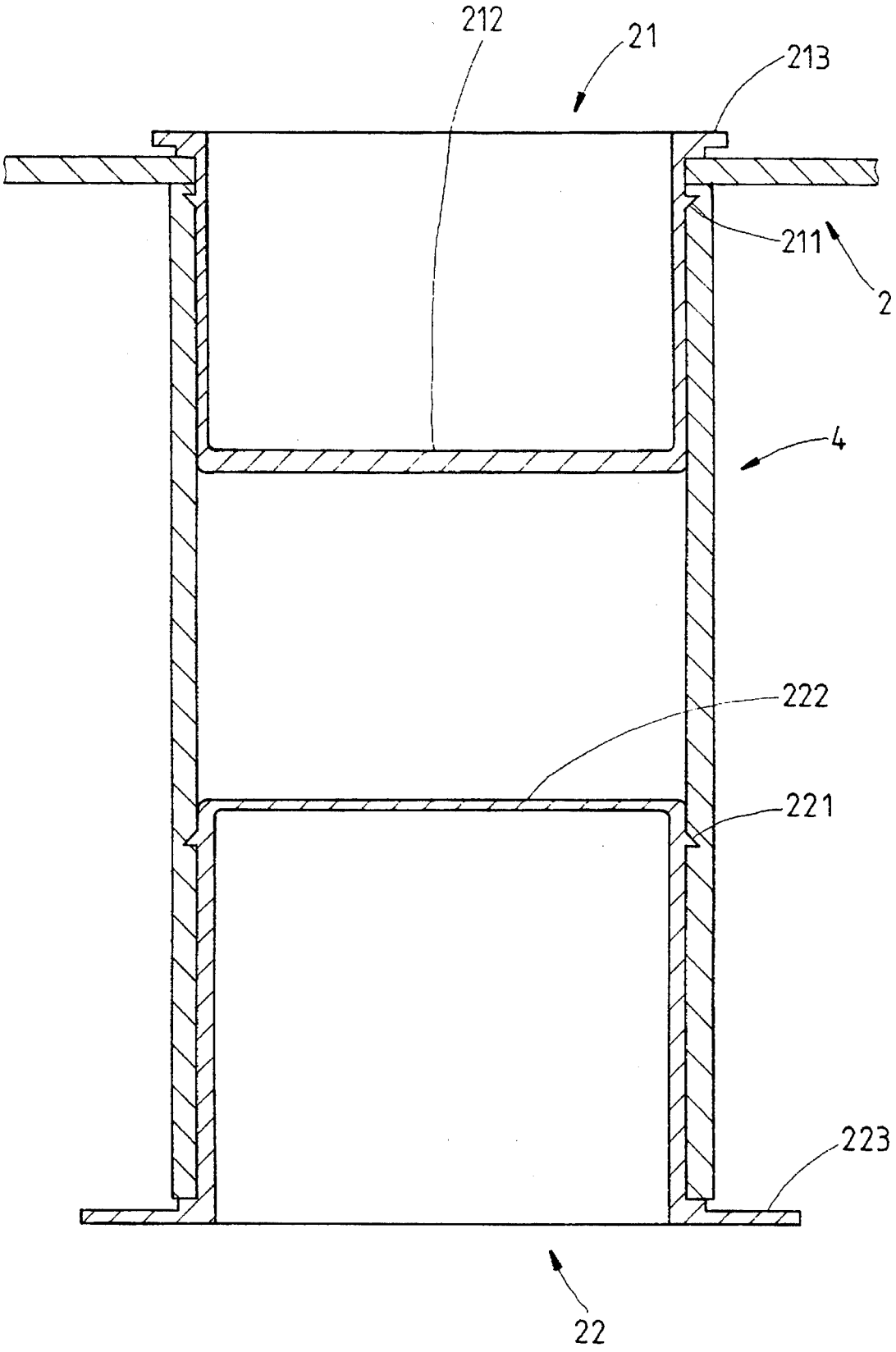
FIG. 3 is a sectional view of the present invention.

Referring to FIG. 2 of the drawings, the present invention is comprised of a bottom plate 2, a plurality of columns composed of a plurality of first assembling members 21, pipes 4 and second assembling members 22. There are a plurality of openings 3 provided on the bottom plate 2. The first assembling members 21 and the second assembling members 22 each is in a form of a high hat, one end of each assembling member 21, 22 is solid to form a closed surface 212, 222, the other end thereof is enlarged to form an annular ring 213, 223, a plurality of protruding members 211, 221 are provided on the assembling member 21, 22 near the closed surface 212, 222. Referring to FIG. 3, the protruding members 211, 221 are each in a form of a right triangle, the bevel surface thereof faces toward the closed surface 212, 222, one of the other two surfaces of the triangular body is integratedly connected with the vertical wall of the assembling member 21, 22. The first assembling members 21 and the second assembling members 22 are made of recyclable plastic, while the pipes 4 are made of paper of high density.

When the paper pallets are used, the first assembling members 21 are inserted from above through the openings 3 provided on each bottom plate 2, the annular rings 213 on the first assembling members 21 can be stopped on the surface around the openings 3, then the pipes 4 and the second assembling members 22 are assembled and slipped over and inserted in respectively from below, the assembled columns are pressed by stepping thereon with the weight of a person to allow the first assembling members 21 and the second assembling members 22 to be inserted into the pipes 4, the inner diameter of the pipes 4 equals to the diameter of the bodys of these assembling members 21, 22, the protruding members 211, 221 in the form of right triangles has slight holding function and render the assembling members 21, 22 inserting into the pipes 4 to be secured and not to drop after assembling, in this way, all the columns are formed.

The present invention has the following advantage:

1. It can be assembled by pressing in a fast and easy way without glue, the pipes 4 are made of paper of high density, so that the protruding members 211, 221 can hold tight thereon and are not easy to come off when they are inserted into the pipes 4 to engage with the walls thereof.

Figure 4:
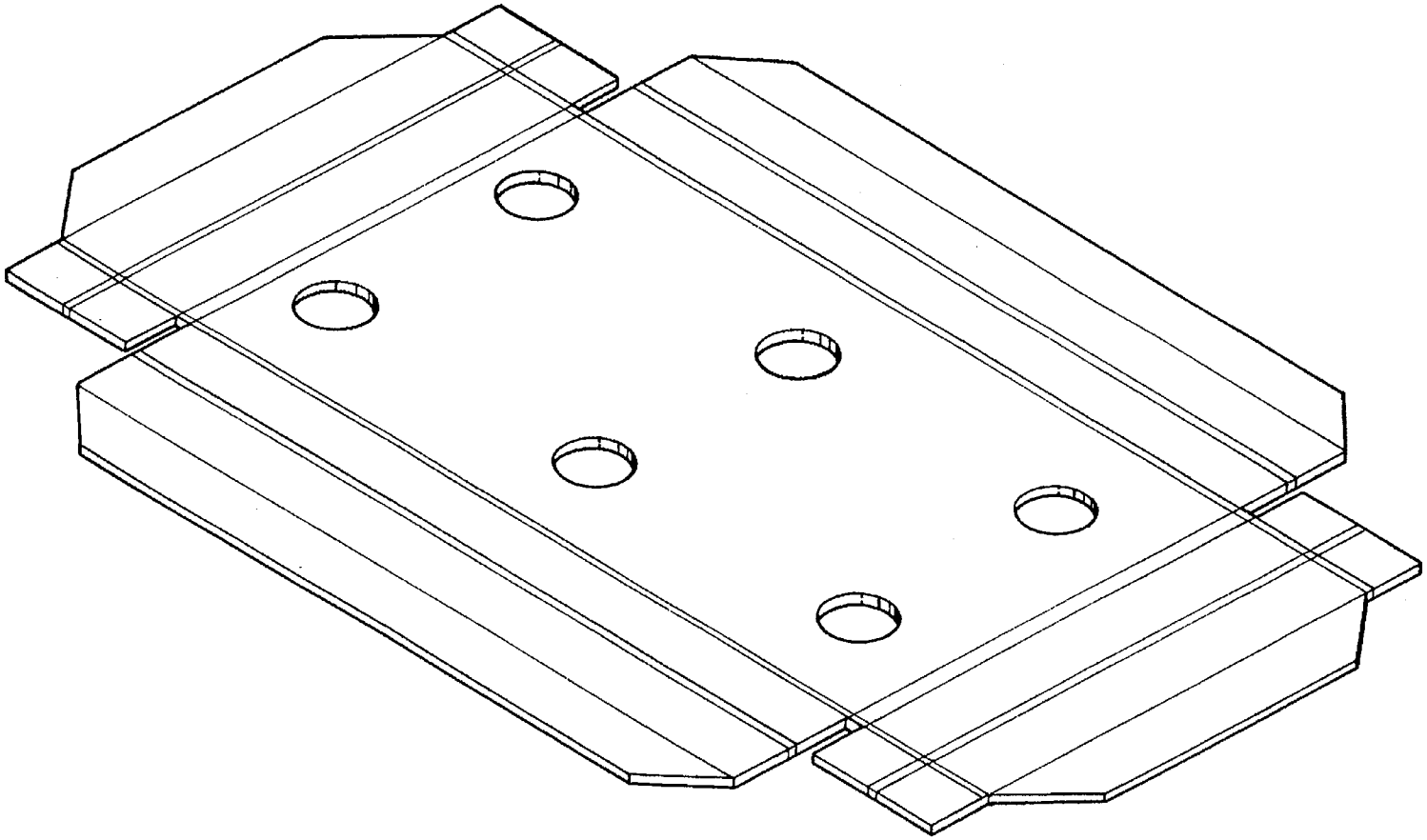
FIG. 4 is a schematic view of the bottom plate of the present invention.

2. It is assembled only when it is to be used, only one paper pallet is required to be assembled for transporting by a stacker, the other paper pallets (such as shown in FIG. 4) can be spreaded out and piled one on the other, in this way, a quite large space can be saved as they are compared to the conventional pallets, and therefore, transportation work and charges can be reduced, yet storing space can be saved, the present invention is practical in deed.

Figure 5:
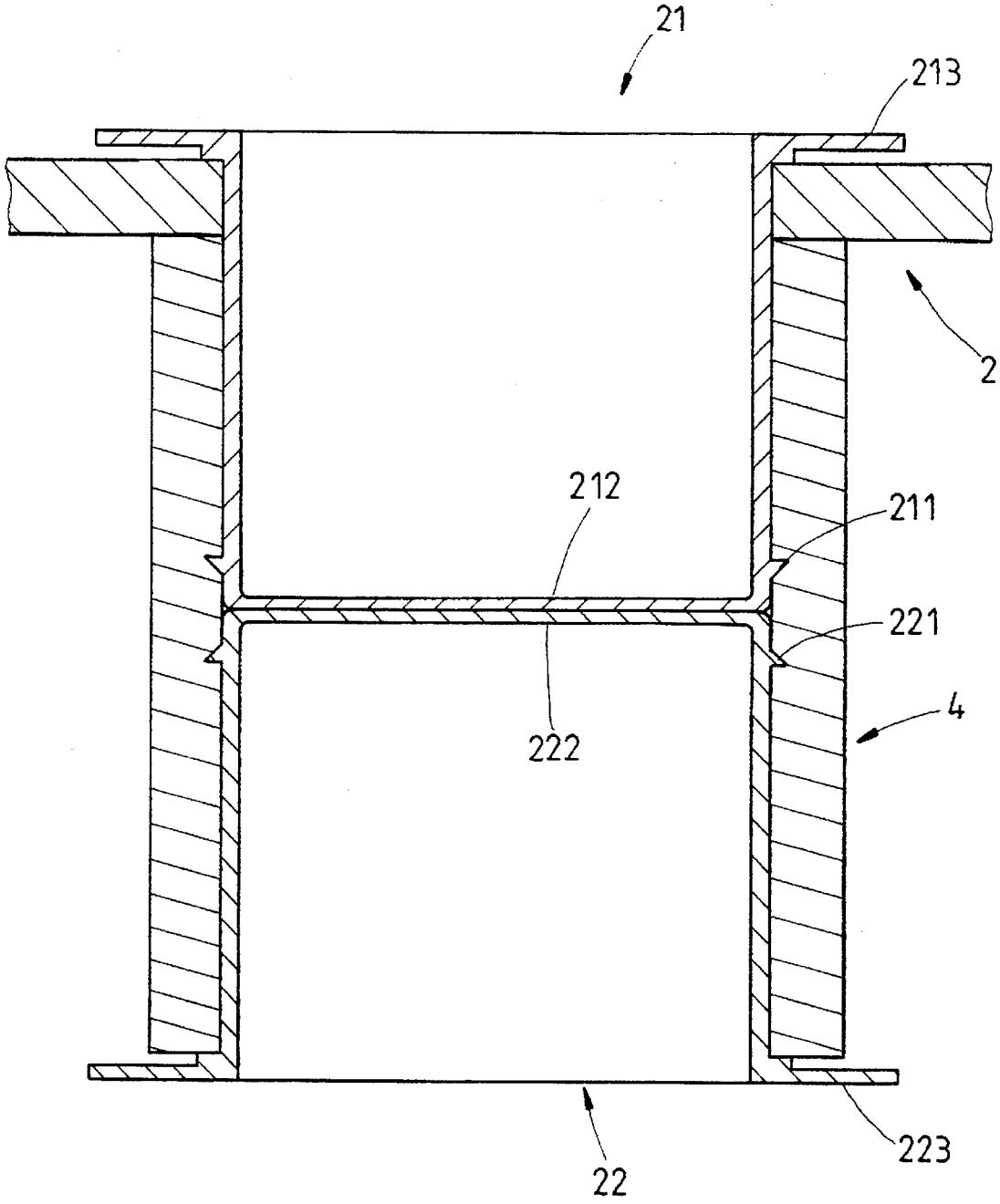
FIG. 5 is a sectional view of an embodiment of the present invention when in assembling.
Figure 6:
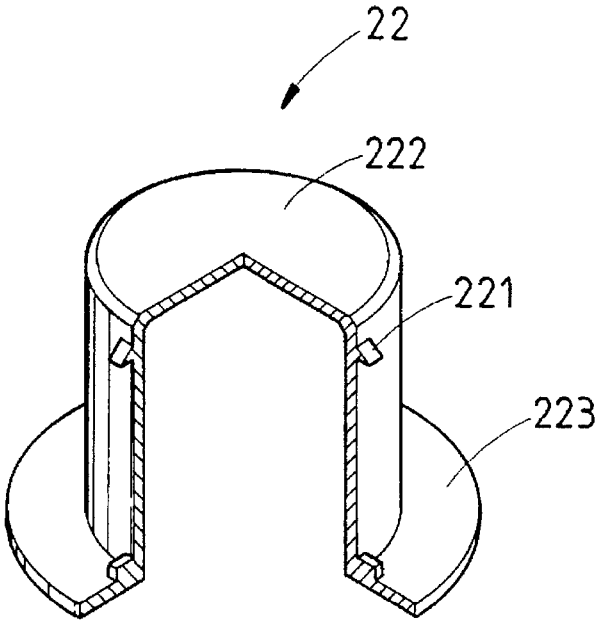
FIG. 6 is an exploded perspective view of an assembling member of the present invention, showing a plurality of protruding members.

As is shown in FIG. 5, the first assembling members 21 can be changed in height, when two of them are arranged close to each other, a paper pallet can bear heavier load, and there are pipes 4 made of paper of high density to cover them, they can endure more weight than the conventional paper pallets. When thickness of the pipes 4 is increased, they can even bear much more weight.

Figure 7:
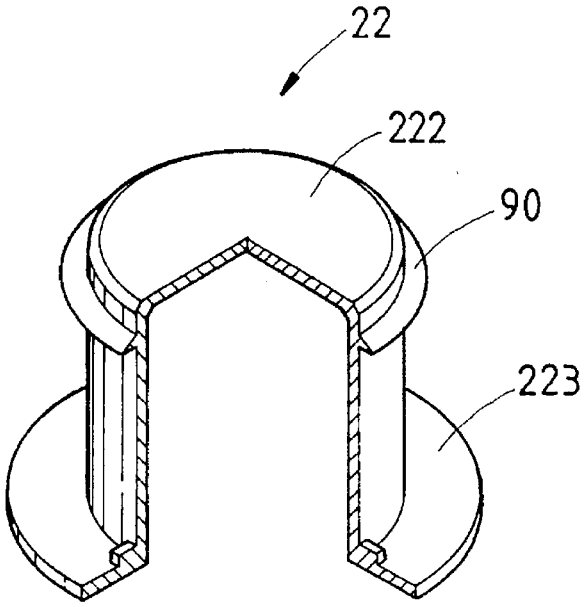
FIG. 7 is another exploded perspective view of another assembling member of the present invention, showing an annular protruding member.
Figure 8:
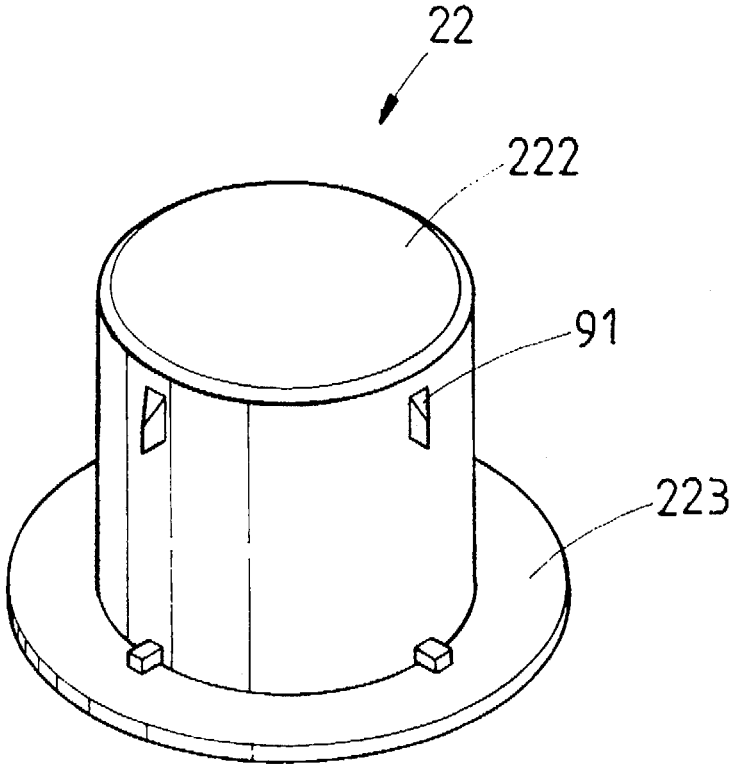
FIG. 8 is an perspective view of another embodiment of assembling member of present invention, having a plurality of elevated protruding members.

As are shown in FIG. 7 and 8, there are other embodiments of the protruding members 211, 221 of the present invention, function of the protruding members 211, 221 is to hold tight on the inner walls of the paper pipes 4, an annular protruding member 90 made of paper or elevated protruding members 91 can be prepared to give the same function.

Figure 9:
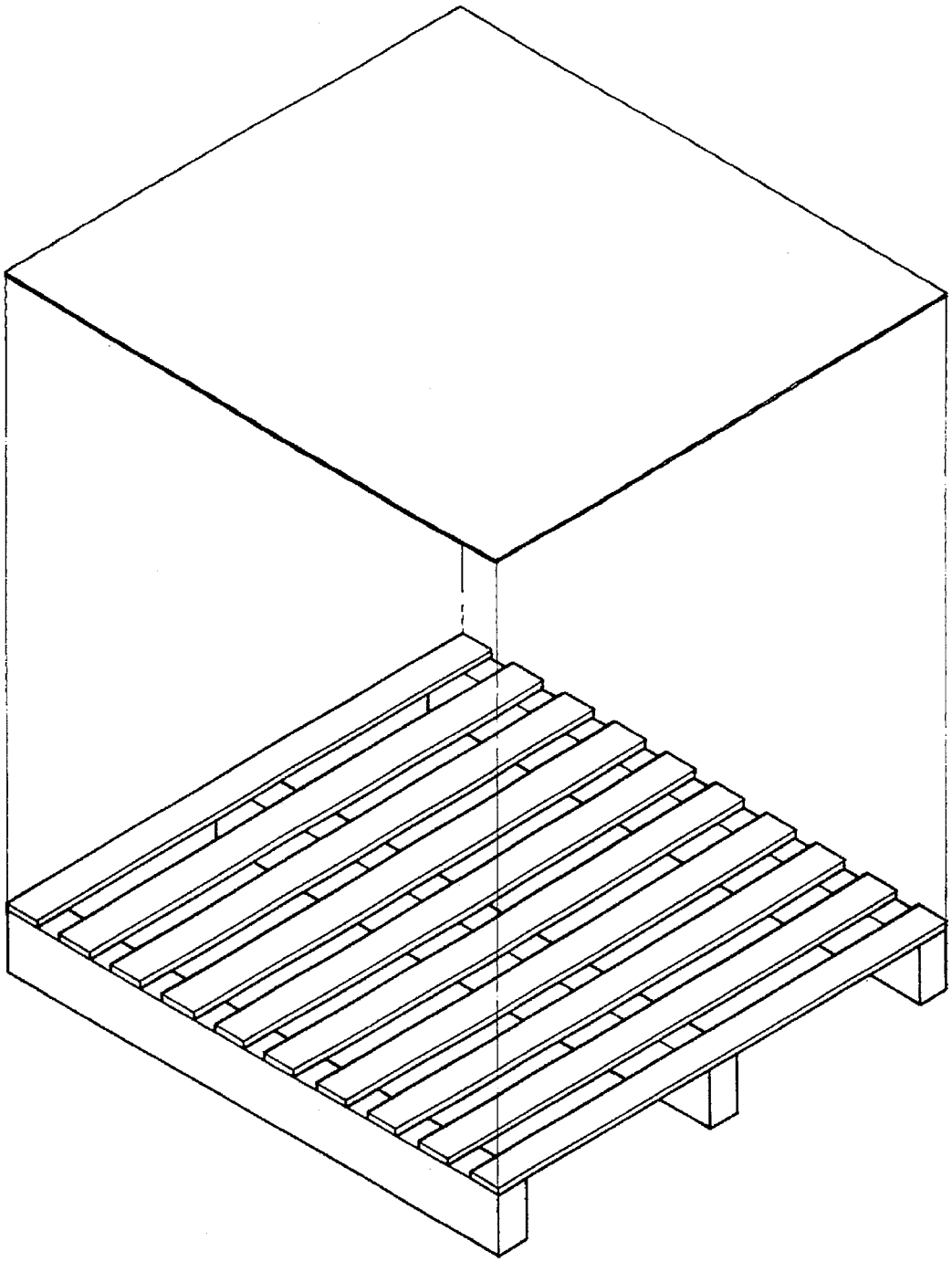
FIG. 9 is a perspective view of a conventional wood pallet.

Referring to FIG. 9 which is a perspective view of a conventional wood pallet, when a big and heavy article is to be packaged, a paper board is bound on the wood pallet to be used as a bottom plate of a packaging case, such wood pallet has the disadvantage stated hereinbefore, and no further statement is required here.

The present invention has been described in reference to an embodiment of paper pallets which is coincedent with requirement of environmental protection, pallets made of wood or ferous material can also be used if they have the same structure and effect as those of the present invention, i.e., are withing the spirit and scope of the present invention.

Having thus described the technical structure of the paper pallets for packing or transporting of my invention having practicability and improveness in easy assembling and convenient transportation, the structure has never existed in the markets, therefore, what I claim as new and desire to be secured by Letters Patent of the United States is:

1. A paper pallet comprising:

a bottom plate with a plurality of openings therein, a plurality of columns, a plurality of first assembling members with first securing means, a plurality of pipes, and a plurality of second assembling members with second securing means; wherein said first assembling members are inserted into said openings in said bottom plate, said first assembling members being secured in said openings by said first securing means, a first end of each of said pipes is received on said first assembling members where they are secured by a friction fit and by said first securing means, a second end of each of said pipes is inserted onto a cylindrical portion of said second assembling members such that said second securing means and a friction fits affixes said second end of said pipes onto said second assembling members; wherein said first and said second securing means comprise protrusions with a right-triangular cross section, said protrusions of said first securing means passing through said openings in said bottom plate such that each said first assembling member is restricted from downward movement by a flange at a top end thereof, and each said first assembling member is restricted from upward movement by said protrusions of said first securing means.

2. The paper pallet of claim 1 wherein:

said protrusions are annular rings.

* * * * *